US005517178A

United States Patent [19]

Rodrigues

[11] Patent Number: 5,517,178

[45] Date of Patent: May 14, 1996

[54] ANTI-THEFT PACKAGE

[75] Inventor: Luciano C. Rodrigues, Taboão da Serra-São Paulo, Brazil

[73] Assignee: Power Systems Industria E Comercio Representacoes Ltda., Sao Paulo, Brazil

[21] Appl. No.: 146,745

[22] Filed: Nov. 3, 1993

[30] Foreign Application Priority Data

Nov. 6, 1992 [BR] Brazil ..... 7201874

[51] Int. Cl.[6] ..... G08B 13/14

[52] U.S. Cl. ..... 340/572; 206/247; 206/387.11

[58] Field of Search ..... 340/572; D27/186, D27/187, 188; 206/387, 580, 247

[56] References Cited

U.S. PATENT DOCUMENTS

| | | | |
|---|---|---|---|
| D. 298,574 | 11/1988 | Long | D27/187 |
| 1,488,044 | 3/1924 | Harms | 206/247 |
| 5,039,982 | 8/1991 | Brohwiler | 206/387 |
| 5,211,283 | 5/1993 | Weisburn | 206/387 |
| 5,239,284 | 8/1993 | Hara | 340/572 |
| 5,277,308 | 1/1994 | Finke | 206/387 |
| 5,285,897 | 2/1994 | Ozaki | 206/387 |

*Primary Examiner*—John K. Peng
*Assistant Examiner*—Albert K. Wong
*Attorney, Agent, or Firm*—Steinberg, Raskin & Davidson

[57] ABSTRACT

An anti-theft package, in particular to prevent the theft of cigarette packs, having a frame and a lid, both having a rectangular cross-section. The frame has rectangular openings on its upper and lower sides, and a hole that passes through the medium portion next to the entrance edge. The lid has a rectangular section which fits inside the frame and an electronic label with a cone-shaped dome. The lid is locked by a peg introduced in the hole of the frame. In an alternative embodiment, the lid is locked by mechanical devices, such as padlocks, safety-locks, etc.

9 Claims, 1 Drawing Sheet

ANTI-THEFT PACKAGE

BACKGROUND OF THE INVENTION

The present invention relates to an anti-theft device, in particular a device to prevent the theft of cigarette packs.

In the prior art, the current technique to prevent the theft of cigarettes involves devices that contain plastic film to hold the packs of cigarettes.

It is a problem at the large and crowded supermarkets that exist in most big cities in the world that such prior art devices are inefficient to prevent theft of cigarette packs due to the impossibility of maintaining a continuous surveillance of the cigarette packs in their stored location. Otherwise, a consumer who does not have very good intentions, and notices the lack of security, might simply destroy the plastic film cover and steal the cigarette packs.

OBJECTS AND SUMMARY OF THE INVENTION

Accordingly, it is an object of the present invention to effectively preventing the breakage of the package of cigarettes and provide a greater degree of anti-theft protection for quantities of cigarette packs.

Briefly, the present invention comprises a plastic frame capable of holding different shapes of cigarette packs that exist. The frame is closed by means of a lid that has a lock which prevents its breakage, thus making it impossible to steal any pack of cigarettes out of the package.

The device comprises a frame containing objects to be protected and a lid arranged to pass into the frame at an entrance edge of the frame. The frame has a hole which passes through a portion of a wall of the frame in proximity to the entrance edge of the frame. An electronic label is arranged on the lid and has a cone-shaped dome. Locking means, e.g., a peg, padlock or safety-lock, operate to lock the lid to the frame to thereby secure the objects to be protected within the frame. The lid is aligned with the frame such that the locking means pass through the hole of the frame and into the cone-shaped dome of the lid. In preferred embodiments, the lid has a cross-sectional shape corresponding to the cross-sectional shape of the frame, and preferably a rectangular cross-sectional shape. Rectangular openings may be arranged on the walls of the frame for, e.g., viewing the objects.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
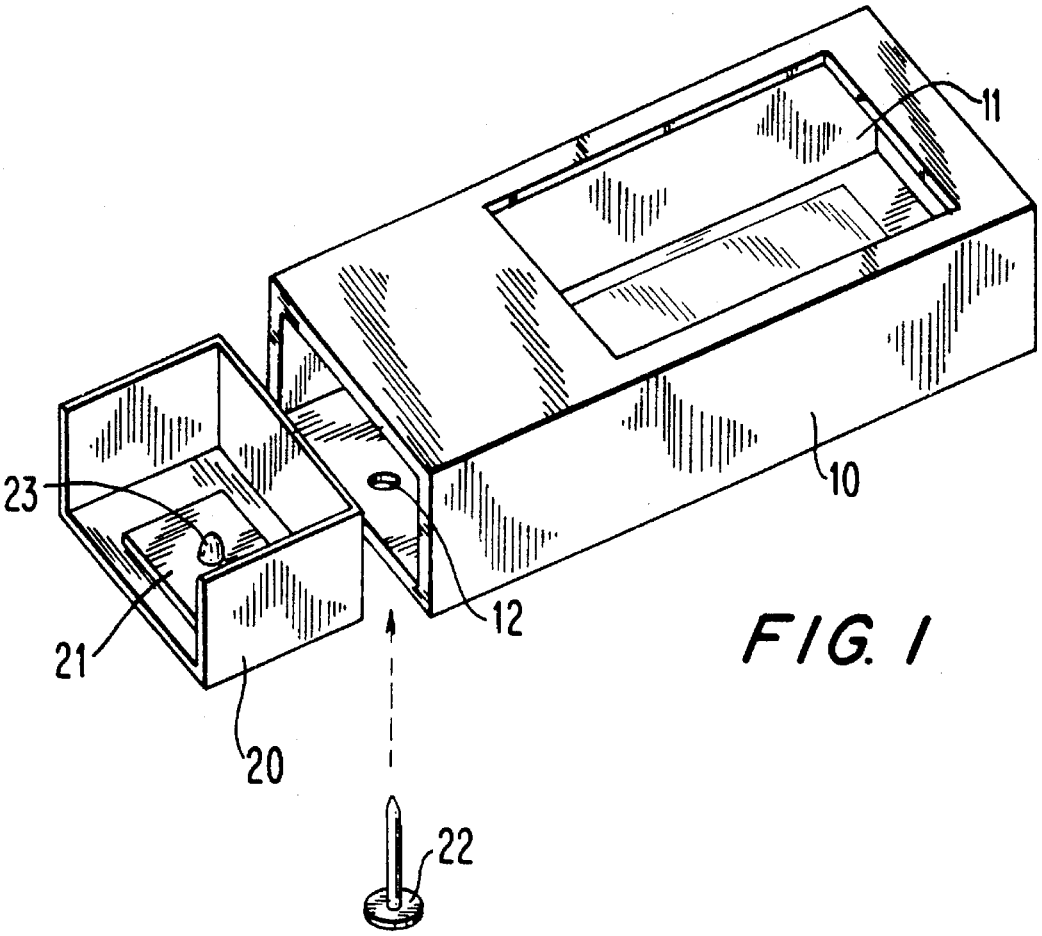
FIG. 1 is a prospective view of an unmounted anti-theft device in accordance with the present invention.
Figure 2:
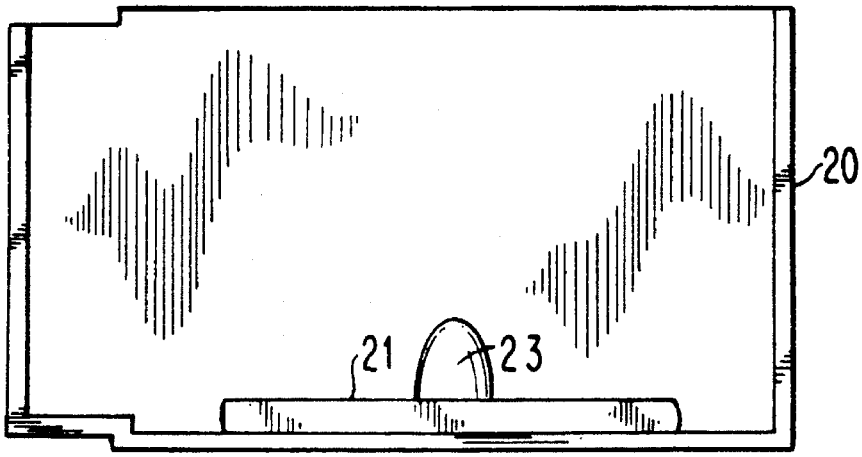
FIG. 2 is a frontal view of the lid of the unmounted anti-theft device in accordance with the present invention.

Referring to FIGS. 1 and 2, the anti-theft device or package includes a plastic frame 10 and and closure means for closing an opening therein, i.e., a lid 20. The frame 10 and the lid 20 are provided with a similar cross-sectional shape, preferably a rectangular cross-section as shown. During use, the lid 20 enters into the frame 10 at an entrance edge thereof.

The frame 10 has rectangular openings 11 on its upper and lower sides, and a circular passing hole 12 located at in medium portion next to or in proximity to the entrance edge of the frame. The introduction of cigarette packs having any shape of size is possible with the use of internal chamfers (not shown) so as to allow for different heights and widths.

The lid 20 has a rectangular section, so that it may fit into the interior of frame 10, and further includes an electronic label 21 which is substantially flat as shown in FIGS. 1 and 2, with a cone-shaped dome 23 in a portion thereof. Inside the label 21, there is a locking device for a peg 22. Alternatively, the electronic label 21 and cone-shaped dome 23 may be replaced by mechanical locking devices, such as padlocks, safety-locks, etc.

In the closed position, the lid 20 is placed in the frame 10 a certain distance such that the center of the dome 23 aligns and coincides with the hole 12 of the frame. In this manner, the lid 20 is locked by peg 22, which can only be removed by means of a special device in the possession of, e.g., the cashier at the supermarket where the cigarettes are sold. The cone-shaped dome is constructed with an open side which receives and retains the peg until the special device is applied, e.g., by the cashier, to separate the peg from the dome.

The electronic label 21 may also contain a sensor whose function is to allow the detection of the frame 10, by means of electronic alarm systems, in the situation in which the entire frame is removed from the supermarket.

The examples provided above are not meant to be exclusive. Many other variations of the present invention would be obvious to those skilled in the art, and are contemplated to be within the scope of the appended claims.

I claim:

1. An anti-theft device for protecting objects from theft, comprising:

a frame having an opening through which objects to be protected are inserted into said frame, said frame comprising a wall having a hole, closure means insertable into said opening for closing said opening to prevent removal of objects from said frame, said closure means comprising a lid arranged to pass into said opening into engagement with said frame, an electronic label fixed to said lid, said electronic label comprising a cone-shaped dome, and locking means for locking said lid to said frame, said locking means being separable from said lid and comprising a locking member insertable through said hole in said wall of said frame and said lid into a locking position with said cone-shaped dome of said electronic label such that said electronic label is locked to said lid and said frame.

2. The device of claim 1, wherein said locking member is a peg.

3. The device of claim 1, wherein said lid has a cross-sectional shape corresponding to the cross-sectional shape of said frame.

4. The device of claim 3, wherein said frame and said lid have a rectangular cross-sectional shape.

5. The device of claim 1, wherein said frame further comprise an upper wall and a lower wall opposed to said upper wall, said lower wall constituting said wall having said hole arranged therein, said upper wall and said lower wall comprising rectangular openings for viewing the objects inserted into said frame.

6. The device of claim 1, wherein said locking member is a padlock.

7. The device of claim 1, wherein said locking member is a safety-lock.

8. The device of claim 5, wherein said hole in said wall is arranged in proximity to said opening of said frame.

9. The device of claim 8, wherein said lid has a cross-sectional shape corresponding to the cross-sectional shape of said frame.

* * * * *